US010354579B2

(12) United States Patent
Maaranen et al.

(10) Patent No.: US 10,354,579 B2
(45) Date of Patent: Jul. 16, 2019

(54) TEMPORARILY INCREASED REFRESH RATE FOR A DISPLAY PANEL IN LOW POWER MODE

(71) Applicant: Microsoft Technology Licensing, LLC, Redmond, WA (US)

(72) Inventors: Tero Maaranen, Tampere (FI); Juha Pänkälä, Ylöjärvi (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/188,969

(22) Filed: Jun. 21, 2016

(65) Prior Publication Data

US 2017/0365207 A1 Dec. 21, 2017

(51) Int. Cl.
*G09G 3/20* (2006.01)

(52) U.S. Cl.
CPC ..... *G09G 3/2096* (2013.01); *G09G 3/2092* (2013.01); *G09G 2310/04* (2013.01); *G09G 2320/0626* (2013.01); *G09G 2330/021* (2013.01); *G09G 2330/022* (2013.01); *G09G 2340/0428* (2013.01); *G09G 2340/0435* (2013.01); *G09G 2360/18* (2013.01)

(58) Field of Classification Search
CPC ..... G09G 2340/0435
USPC ..... 345/520
See application file for complete search history.

(56) References Cited

U.S. PATENT DOCUMENTS 5,991,883 A 11/1999 Atkinson
7,233,309 B2 6/2007 Diefenbaugh et al.
7,325,100 B2 1/2008 Dhiman et al.
9,098,275 B2 8/2015 Chun
2008/0055318 A1 3/2008 Glen
2008/0143695 A1 6/2008 Juenemann et al.
2013/0021352 A1* 1/2013 Wyatt ..... G09G 5/395 345/520
2013/0265294 A1 10/2013 Kim
2014/0104243 A1 4/2014 Sakariya et al.
2014/0198093 A1* 7/2014 Nambi ..... G09G 3/36 345/212
2015/0193062 A1 7/2015 Wyatt
2015/0339994 A1* 11/2015 Verbeure ..... G09G 3/2044 345/214

OTHER PUBLICATIONS

Baker, Simon, "Variable Refresh Rates G-sync and FreeSync", Published on: Jun. 5, 2015, 13 pages, Available at: http://www.tftcentral.co.uk/articles/variable_refresh.htm.

* cited by examiner

*Primary Examiner* — Shivang I Patel

(57) ABSTRACT

In one example, an apparatus comprises a display panel having a first active mode with a first refresh rate and at least one of a first bit depth or a first brightness, and further having a second active mode with a second refresh rate and at least one of a second bit depth or a second brightness, the second refresh rate being lower than the first refresh rate, the second bit depth being lower than the first bit depth, and the second brightness being lower than the first brightness. The apparatus further comprises a controller. In response to receiving an image update request while the display panel is in the second active mode, the controller is configured to otherwise keep the display panel in the second active mode but switch the display panel to an intermediate refresh rate higher than the second refresh rate until completion of the image update request.

20 Claims, 4 Drawing Sheets

TEMPORARILY INCREASED REFRESH RATE FOR A DISPLAY PANEL IN LOW POWER MODE

BACKGROUND

In addition to a normal active mode, display panels may have a second active mode that consumes less power while still allowing the display panel to be continuously refreshed from a frame buffer memory. Such a low power active mode typically has a significantly lower refresh rate than the normal active mode. A low refresh rate may make it difficult to display smooth transitions and animations on the display panel.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one example, an apparatus comprises a display panel having a first active mode with a first refresh rate and at least one of a first bit depth or a first brightness, and further having a second active mode with a second refresh rate and at least one of a second bit depth or a second brightness, the second refresh rate being lower than the first refresh rate, the second bit depth being lower than the first bit depth, and the second brightness being lower than the first brightness. The apparatus further comprises a controller. In response to receiving an image update request while the display panel is in the second active mode, the controller is configured to otherwise keep the display panel in the second active mode but switch the display panel to an intermediate refresh rate higher than the second refresh rate until completion of the image update request.

In another example, a display unit and a method have been discussed along with the features of the apparatus.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of operations for constructing and operating the example. However, the same or equivalent functions and sequences may be accomplished by different examples.

At least some of the disclosed examples may allow temporarily increasing refresh rate for a display panel that is in a low power mode, thereby allowing smooth image transitions and animations to be displayed in the low power mode.

Figure 1:
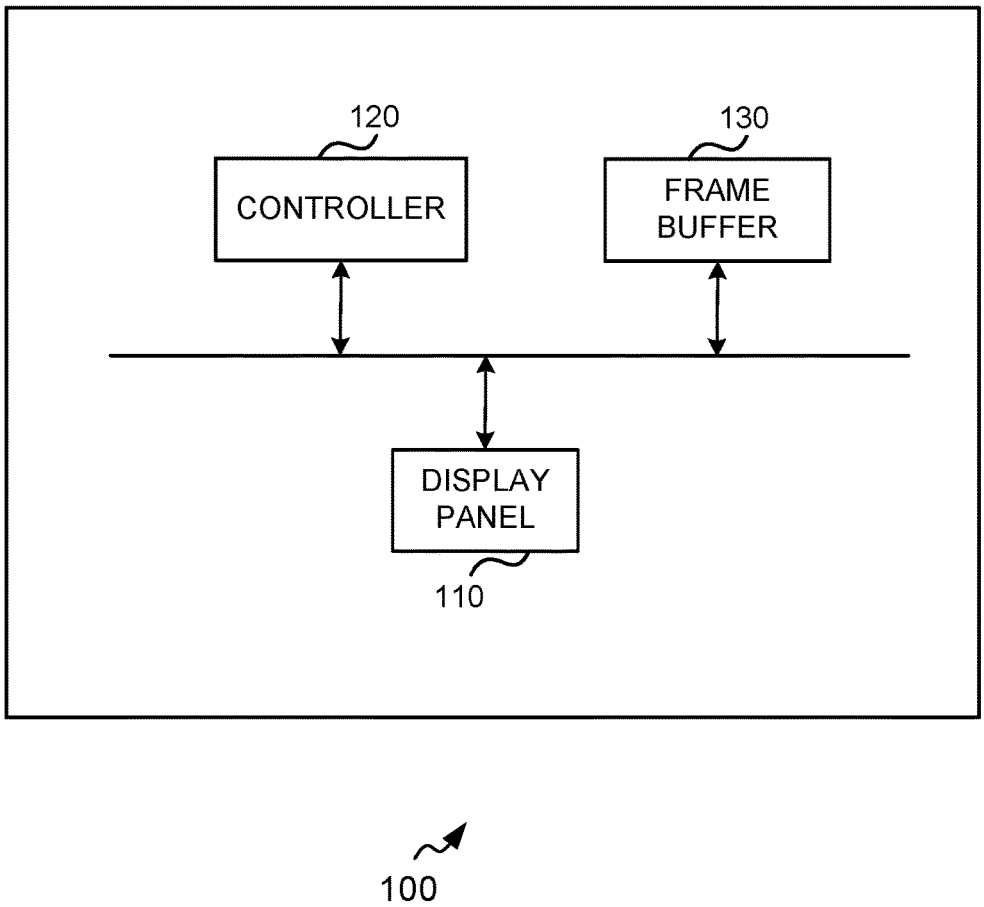
FIG. 1 is an example block diagram of an apparatus in accordance with an example embodiment.

FIG. 1 illustrates an apparatus 100 in accordance with an example embodiment. The apparatus 100 may be employed, for example, in the electronic device 400 of FIG. 4. However, it should be noted that the apparatus 100 may also be employed on a variety of other devices and apparatuses, and therefore, embodiments should not be limited to application on devices and apparatuses such as the electronic device 400 of FIG. 4. Furthermore, it should be noted that at least some of the elements described below may not be mandatory and thus some may be omitted in certain embodiments. The apparatus 100 may include e.g. mobile communication devices (such as smart phones, tablet computers, and the like), digital cameras, virtual reality (VR) devices, and the like.

The apparatus 100 comprises a digital display panel 110. The display panel 110 may be based on e.g. liquid-crystal display (LCD) technology, organic light-emitting diode (OLED) technology, or the like.

The display panel 110 has at least a first active mode and second active mode. Herein, the term "active" is used to indicate that at least a portion of the display panel 110 is continuously being refreshed, e.g. from an internal frame buffer 130. In other words, active (or non-zero power) mode excludes various power saving modes and the like in which the display panel 110 is off.

The first active mode comprises a first refresh rate and at least one of a first bit depth or a first brightness. The second active mode comprises a second active mode with a second refresh rate and at least one of a second bit depth or a second brightness. The second refresh rate is lower than the first refresh rate, the second bit depth is lower than the first bit depth, and the second brightness is lower than the first brightness.

The first active mode may comprise a normal power mode of the display panel 110, and the second active mode may comprise a non-zero low power mode of the display panel 110.

The normal power mode of the display panel 110 may be utilized e.g. when the user is interacting with the apparatus 100 and/or the display panel 110. The non-zero low power mode of the display panel 110 may be utilized e.g. when the apparatus 100 displays information (such as notifications, date, time, and the like) without the user having been interacting with the apparatus 100 and/or the display panel 110 for a period of time. In some embodiments, with the display panel 110 in the non-zero low power mode, the apparatus 100 may display this information without display back-lighting. In some embodiments, the non-zero low power mode may be utilized when the apparatus 100 has a blocking proximity sensor that is subsequently unblocked, e.g. when the user takes the apparatus 100 out of pocket, or holds a hand over the apparatus 100 and then moves it away. In other words, the non-zero low power mode of the display panel 110 consumes less power than the normal power mode while still allowing the display panel 110 to be continuously refreshed from a frame buffer memory.

In an example, the first refresh rate is e.g. 60 hertz, and the second refresh rate is e.g. in a range of 1-30 hertz. For example, the second refresh rate may be 15 hertz. In an example, the first bit depth is e.g. 24 bits per pixel, and the second bit depth is e.g. 3 bits per pixel.

The brightness may be adjusted e.g. by adjusting backlight of the display panel 110. This applies e.g. to display panels based on LCD technology. Alternatively or in addition, the brightness may be adjusted e.g. by adjusting voltage(s) and/or by turning off a portion of the pixels of the display panel 110. This applies e.g. to display panels based on OLED technology.

The apparatus 100 further comprises a controller 120. The controller 120 may comprise a driver associated with the display panel 110. The driver may be a hardware driver. The apparatus 100 may further comprise a frame buffer 130 that is configured to store image data to be displayed on the display panel 110.

In response to receiving an image update request while the display panel 110 is in the second active mode, the controller 120 is configured to switch the display panel 110 to an intermediate refresh rate higher than the second refresh rate until completion of the image update request (yet otherwise keep the display panel 110 in the second active mode). In an example, the intermediate refresh rate is e.g. 45 hertz. In another example, the intermediate refresh rate is e.g. 60 hertz.

The image update request may include e.g. request to update information content of at least one pixel of the display panel 110. For example, the image update request may comprise a request draw an image transition or an image animation on the display panel 110. In an example, the image transition or image animation may be related to a display notification about an incoming phone call or a message, such an email message or a short message service (SMS) message, or the like. In a further example, the image transition or image animation may be related to an animated display element, such as a clock face or a volume indicator.

The controller 120 may be further configured to switch the display panel 110 to the second refresh rate after the completion of the image update request.

Figure 2:
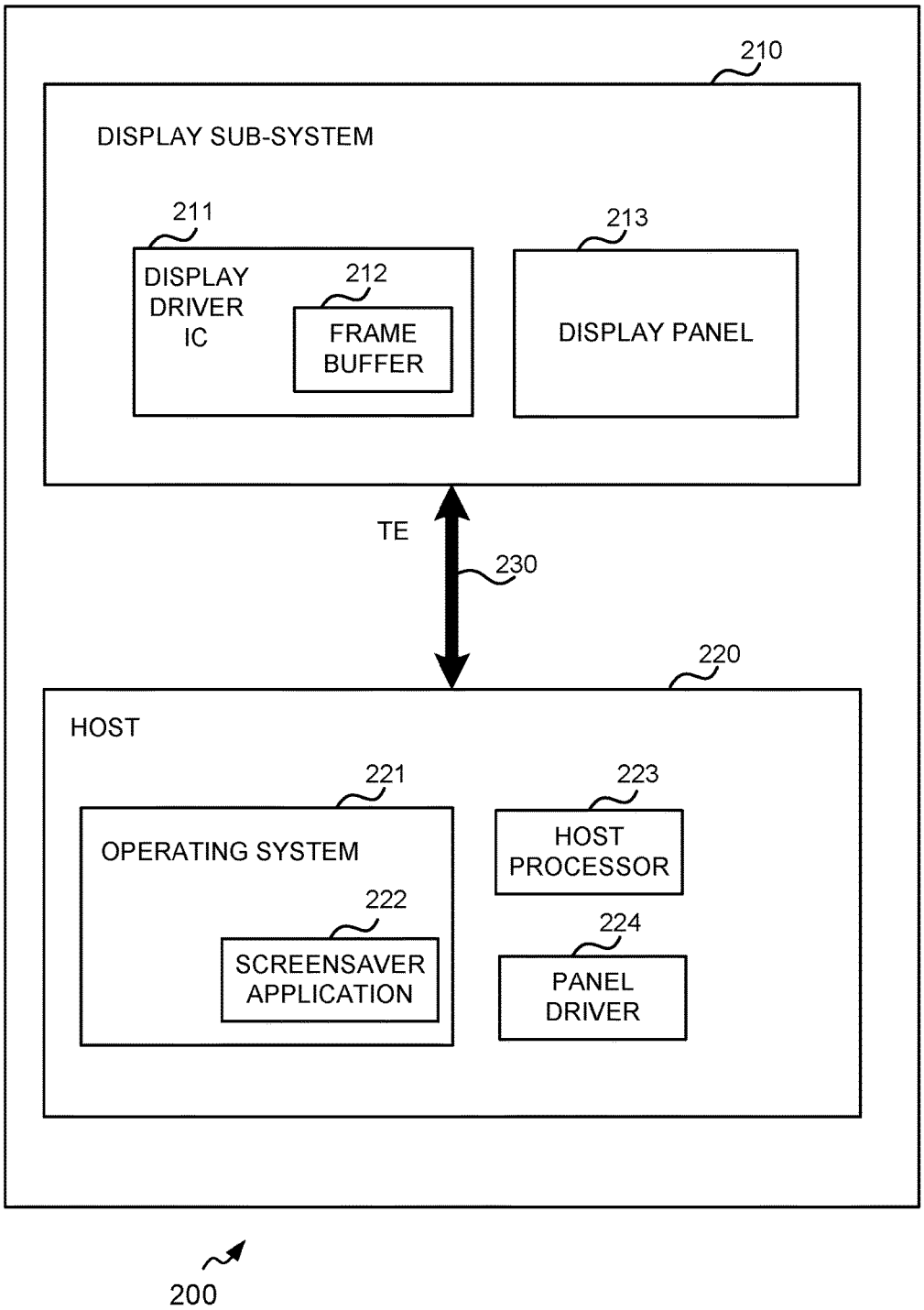
FIG. 2 is another example block diagram of an apparatus in accordance with an example embodiment.

FIG. 2 illustrates an apparatus 200 in accordance with an example embodiment. The apparatus 200 may be employed, for example, in the electronic device 400 of FIG. 4. However, it should be noted that the apparatus 200 may also be employed on a variety of other devices and apparatuses, and therefore, embodiments should not be limited to application on devices and apparatuses such as the electronic device 400 of FIG. 4. Furthermore, it should be noted that at least some of the elements described below may not be mandatory and thus some may be omitted in certain embodiments. The apparatus 200 may include e.g. mobile communication devices (such as smart phones, tablet computers, and the like), digital cameras, virtual reality (VR) devices, and the like.

In the example of FIG. 2, the functionalities and properties of the display panel 213 are similar to those of its counterpart (i.e. display panel 110) in the example of FIG. 1, so their descriptions are not repeated here in detail. Similarly, the functionalities and properties of the controller/display driver 211 are similar to those of its counterpart (i.e. controller 120) in the example of FIG. 1, so their descriptions are not repeated here in detail. Similarly, the functionalities and properties of the frame buffer 212 are similar to those of its counterpart (i.e. frame buffer 130) in the example of FIG. 1, so their descriptions are not repeated here in detail.

The apparatus 200 comprises a display sub-system 210 and a host 220. The display sub-system 210 comprises a display driver integrated circuit (IC) 211 with an internal frame buffer memory 212, and a display panel 213. The host 220 comprises an operating system 221 with a screensaver application 222. The host 220 further comprises a host processor 223 and a panel driver 224.

The display sub-system 210 and the host 220 are communicatively connected by a device control interface 230. The device control interface 230 comprises a transmission configured to carry display control and image data, including e.g. a tearing effect (TE) synchronization signal that is output from the display sub-system 210 and that indicates the current refresh rate and scanning phase of the display panel 213.

In an example, the panel driver 224 may respond to higher level requests from the operating system 221 or the screensaver application 222, asking the host processor 223 to send data over the device control interface 230.

The display sub-system 210 includes a display module with the display driver IC 211, frame buffer 212, and powering logic. A command set for register access may be included allowing the host 220 to adjust the display panel 213 refresh rate during the low power mode. The display sub-system 210 has low power mode functions for e.g. screensaver purposes that may be set to e.g. apply reduced colors and/or a reduced active area, lower refresh rate and/or lower luminance.

The frame buffer 212 is configured to store image data. The frame buffer 212 may comprise compressed/uncompressed or partial frame memory. When in active mode or state, the display panel 213 is continuously refreshed from the frame buffer 212.

In the low power mode (e.g. screensaver mode) the display panel 213 refresh rate may be temporarily increased to allow e.g. smooth image transitions during the screensaver or the like. Accordingly, no change from low power display mode to a normal display mode is needed.

Figure 3:
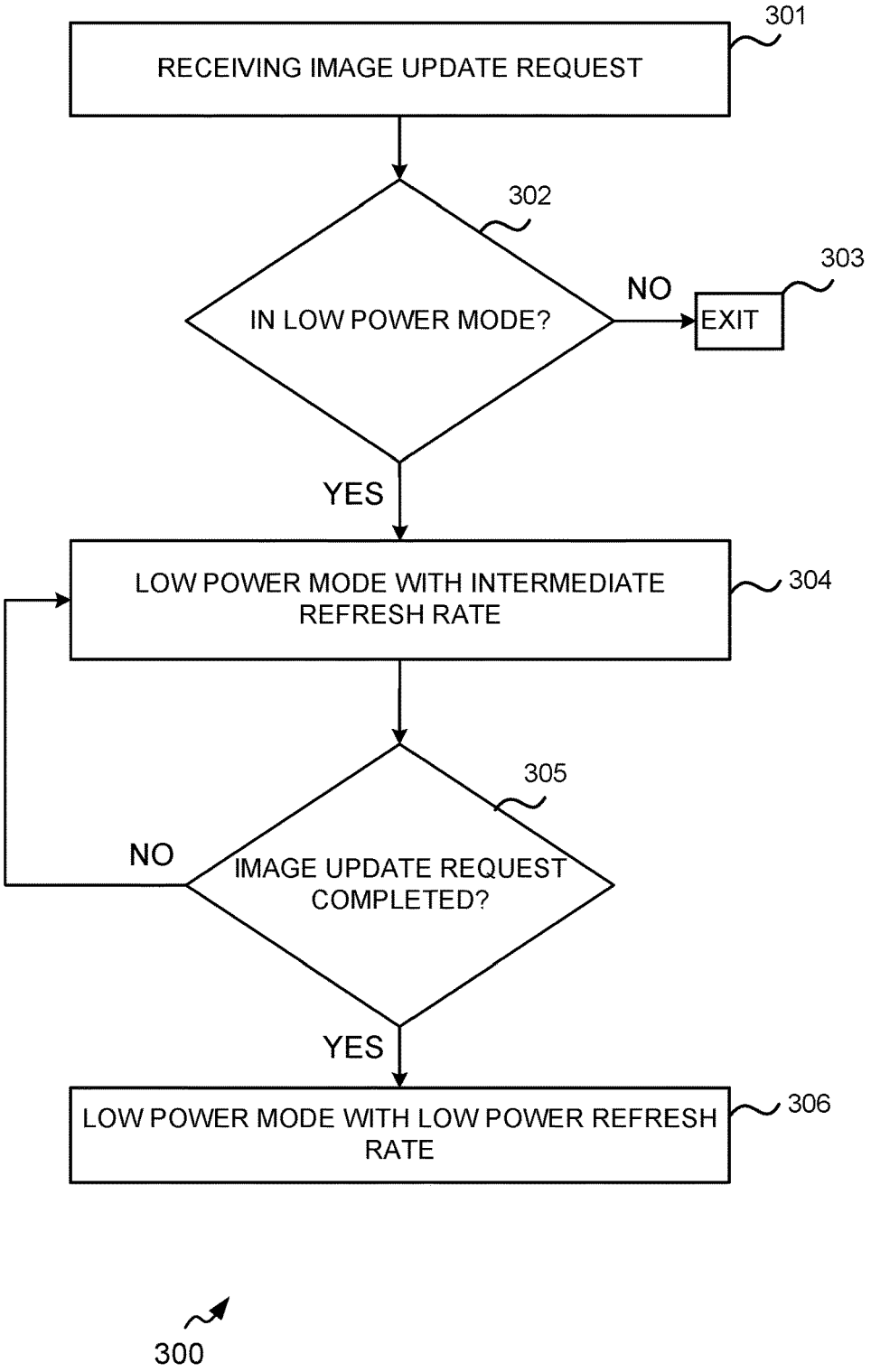
FIG. 3 is an example flow diagram of a method in accordance with example embodiments.

FIG. 3 is an example flow diagram of a method 300 in accordance with an example embodiment. At operation 301, an image update request is received in a controller associated with a display panel. As discussed above, the image update request may include e.g. request to update information content of at least one pixel of the display panel. For example, the image update request may comprise a request draw an image transition or an image animation on the display panel.

The display panel has a first active mode with a first refresh rate and a first bit depth and/or a first brightness, and further has a second active mode with a second refresh rate and a second bit depth and/or a second brightness. The second refresh rate is lower than the first refresh rate, the second bit depth is lower than the first bit depth, and the second brightness is lower than the first brightness.

The first active mode may comprise a normal power mode, and the second active mode may comprise a non-zero low power mode. In an example, the first refresh rate is e.g. 60 hertz, and the second refresh rate is e.g. in a range of 1-30 hertz. For example, the second refresh rate may be 15 hertz. In an example, the first bit depth is e.g. 24 bits per pixel, and the second bit depth is e.g. 3 bits per pixel.

At operation 302, it is determined whether the display panel is in the second active mode. If not, the method exits at operation 303. If yes, the method proceeds to operation 304.

At operation 304, the display panel is switched by the controller to an intermediate refresh rate higher than the second refresh rate, while otherwise keeping the display panel otherwise in the second active mode (i.e. keeping the second bit depth and/or the second brightness, as applicable). In an example, the intermediate refresh rate is e.g. 45 hertz. In another example, the intermediate refresh rate is e.g. 60 hertz.

At operation 305, it is determined whether the image update request has been completed. If not, the method returns to operation 304. If yes, the method proceeds to operation 306.

At operation 306, i.e. after the completion of the image update request, the display panel is switched by the controller back to the second refresh rate.

Operations 301-306 may be performed e.g. by the controller 120 of FIG. 1 and/or by the display driver 211 of FIG. 2.

Figure 4:
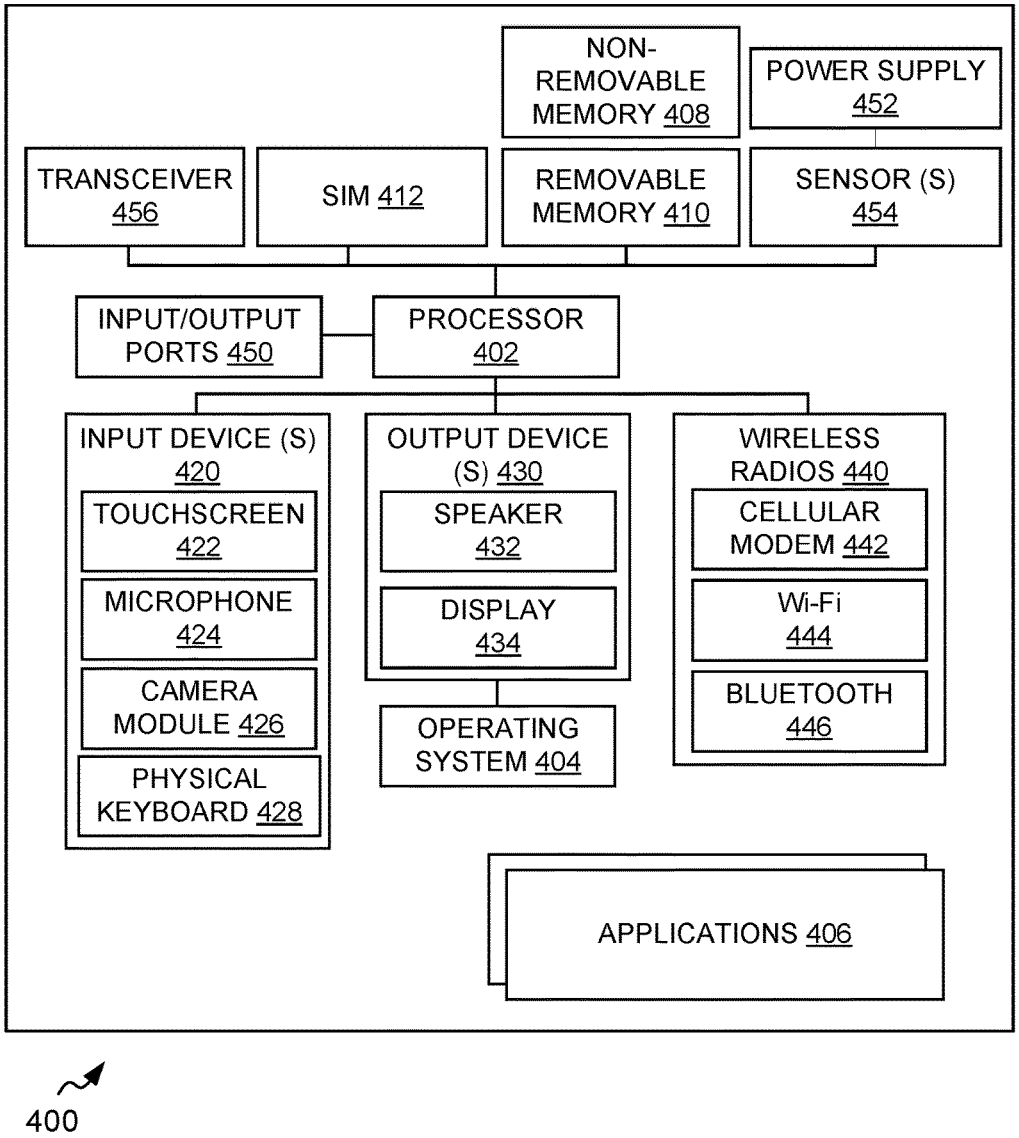
FIG. 4 illustrates an example block diagram of an electronic device capable of implementing example embodiments described herein.

FIG. 4 is a schematic block diagram of an electronic device 400 capable of implementing embodiments of the techniques described herein. It should be understood that the electronic device 400 as illustrated and hereinafter described is merely illustrative of one type of apparatus or an electronic device and should not be taken to limit the scope of the embodiments. As such, it should be appreciated that at least some of the components described below in connection with the electronic device 400 may be optional and thus in an example embodiment may include more, less or different components than those described in connection with the example embodiment of FIG. 4. As such, among other examples, the electronic device 400 could be any of apparatuses incorporating a digital display panel with an internal frame buffer. For example, the electronic device 400 may be implemented as a stand-alone digital camera device, or the electronic device 400 may be implemented e.g. as a smartphone, a tablet computer, or a virtual reality device.

The illustrated electronic device 400 includes a controller or a processor 402 (i.e. a signal processor, microprocessor, ASIC, or other control and processing logic circuitry) for performing such tasks as signal coding, data processing, input/output processing, power control, and/or other functions. An operating system 404 controls the allocation and usage of the components of the electronic device 400 and support for one or more application programs 406. The application programs 406 can include common mobile applications, for instance, telephony applications, email applications, calendars, contact managers, web browsers, messaging applications, or any other application.

The illustrated electronic device 400 includes one or more memory components, for example, a non-removable memory 408 and/or removable memory 410. The non-removable memory 408 may include RAM, ROM, flash memory, a hard disk, or other well-known memory storage technologies. The removable memory 410 may include flash memory or smart cards. The one or more memory components may be used for storing data and/or code for running the operating system 404 and the applications 406. Example of data may include web pages, text, images, sound files, image data, video data, or other data sets to be sent to and/or received from one or more network servers or other devices via one or more wired or wireless networks. The electronic device 400 may further include a subscriber identity module (SIM) 412. The SIM 412 typically stores information elements related to a mobile subscriber. A SIM is well known in Global System for Mobile Communications (GSM) communication systems, Code Division Multiple Access (CDMA) systems, or with third-generation (3G) wireless communication protocols such as Universal Mobile Telecommunications System (UMTS), CDMA1000, wideband CDMA (WCDMA) and time division-synchronous CDMA (TD-SCDMA), or with fourth-generation (4G) wireless communication protocols such as LTE (Long-Term Evolution). The SIM 412 may comprise a virtual SIM. Furthermore, multiple SIMs may be utilized.

The electronic device 400 can support one or more input devices 420 and one or more output devices 430. Examples of the input devices 420 may include, but are not limited to, a touchscreen 422 (i.e., capable of capturing finger tap inputs, finger gesture inputs, multi-finger tap inputs, multi-finger gesture inputs, or keystroke inputs from a virtual keyboard or keypad), a microphone 424 (i.e., capable of capturing voice input), a camera module 426 (i.e., capable of capturing still picture images and/or video images) and a physical keyboard 428. Examples of the output devices 430 may include, but are not limited to a speaker 432 and a display 434. The display 434 may include the display elements 110-130 of FIG. 1 or the display sub-system 210 of FIG. 2. Other possible output devices (not shown) can include piezoelectric or other haptic output devices. Some devices can serve more than one input/output function. For example, the touchscreen 422 and the display 434 can be combined into a single input/output device.

In an embodiment, the electronic device 400 may comprise a wireless radio(s) 440. The wireless radio(s) 440 can support two-way communications between the processor 402 and external devices, as is well understood in the art. The wireless radio(s) 440 are shown generically and can include, for example, a cellular modem 442 for communicating at long range with the mobile communication network, a Wi-Fi radio 444 for communicating at short range with a local wireless data network or router, and/or a BLUETOOTH radio 446. The cellular modem 442 is typically configured for communication with one or more cellular networks, such as a GSM/3G/4G network for data and voice communications within a single cellular network, between cellular networks, or between the mobile device and a public switched telephone network (PSTN).

The electronic device 400 can further include one or more input/output ports 450, a power supply 452, one or more sensors 454, for example an accelerometer, a gyroscope, a compass, or an infrared proximity sensor for detecting the orientation or motion of the electronic device 400, and a transceiver 456 (for wirelessly transmitting analog or digital signals). The illustrated components are not required or all-inclusive, as any of the components shown can be deleted and other components can be added.

Computer executable instructions may be provided using any computer-readable media that is accessible by computing based devices. Computer-readable media may include, for example, computer storage media such as memory and communications media. Computer storage media, such as memory includes volatile and non-volatile, removable and non-removable media implemented in any method or technology for storage of information such as computer readable instructions, data structures, program modules or the like. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or the like in a modulated data signal, such as a carrier wave, or other transport mechanism. As defined herein, computer storage media does not include communication media. Therefore, a computer storage medium should not be interpreted to be a propagating signal per se. Although the computer storage media is shown within the computing based devices it will be appreciated that the storage may be distributed or located remotely and accessed via a network or other communication link, for example by using a communication interface.

At least some of the examples disclosed in FIGS. 1-4 are able to provide temporarily increasing refresh rate for a display panel that is in a low power mode, thereby allowing smooth and/or visually pleasing image transitions and animations to be displayed in the low power mode. At least some of the examples disclosed in FIGS. 1-4 are able to provide smooth image transitions and animations to be displayed without having to exit from the low power mode to normal or full power mode. Accordingly, at least some of the examples disclosed in FIGS. 1-4 are able to provide smooth image transitions and animations to be displayed without having to waste time or power to enter the normal or full power mode for displaying the smooth image transitions or animations.

An embodiment of an apparatus comprises a display panel having a first active mode with a first refresh rate and at least one of a first bit depth or a first brightness, and further having a second active mode with a second refresh rate and at least one of a second bit depth or a second brightness, the second refresh rate being lower than the first refresh rate, the second bit depth being lower than the first bit depth, and the second brightness being lower than the first brightness; and a controller, wherein, in response to receiving an image update request while the display panel is in the second active mode, the controller is configured to otherwise keep the display panel in the second active mode but switch the display panel to an intermediate refresh rate higher than the second refresh rate until completion of the image update request.

In an embodiment, alternatively or in addition to the above described embodiments, the controller is further configured to switch the display panel to the second refresh rate after the completion of the image update request.

In an embodiment, alternatively or in addition to the above described embodiments, the first active mode comprises a normal power mode.

In an embodiment, alternatively or in addition to the above described embodiments, the second active mode comprises a non-zero low power mode.

In an embodiment, alternatively or in addition to the above described embodiments, the first refresh rate is 60 hertz, and the second refresh rate is in a range of 1-30 hertz.

In an embodiment, alternatively or in addition to the above described embodiments, the second refresh rate is 15 hertz.

In an embodiment, alternatively or in addition to the above described embodiments, the first bit depth is 24 bits per pixel, and the second bit depth is 3 bits per pixel.

In an embodiment, alternatively or in addition to the above described embodiments, the intermediate refresh rate is one of 45 hertz and 60 hertz.

In an embodiment, alternatively or in addition to the above described embodiments, the controller comprises a driver associated with the display panel.

In an embodiment, alternatively or in addition to the above described embodiments, the apparatus further comprises a frame buffer configured to store image data to be displayed on the display panel.

In an embodiment, alternatively or in addition to the above described embodiments, the image update request requests updating information content of at least one pixel of the display panel.

In an embodiment, alternatively or in addition to the above described embodiments, the image update request comprises an image transition request.

An embodiment of a display unit comprises a display panel having a first active mode with a first refresh rate and at least one of a first bit depth or a first brightness, and further having a second active mode with a second refresh rate and at least one of a second bit depth or a second brightness, the second refresh rate being lower than the first refresh rate, the second bit depth being lower than the first bit depth, and the second brightness being lower than the first brightness; a controller; and a frame buffer configured to store image data to be displayed on the display panel, wherein, in response to receiving an image update request while the display panel is in the second active mode, the controller is configured to otherwise keep the display panel in the second active mode but switch the display panel to an intermediate refresh rate higher than the second refresh rate until completion of the image update request.

An embodiment of a method comprises receiving, in a controller associated with a display panel, an image update request while the display panel is in a second active mode, the display panel having a first active mode with a first refresh rate and at least one of a first bit depth or a first brightness, and further having the second active mode with a second refresh rate and at least one of a second bit depth or a second brightness, the second refresh rate being lower than the first refresh rate, the second bit depth being lower than the first bit depth, and the second brightness being lower than the first brightness; and in response to receiving the image update request while the display panel is in the second active mode, keeping the display panel otherwise in the second active mode but switching, by the controller, the display panel to an intermediate refresh rate higher than the second refresh rate until completion of the image update request.

In an embodiment, alternatively or in addition to the above described embodiments, the method further comprises switching, by the controller, the display panel to the second refresh rate after the completion of the image update request.

In an embodiment, alternatively or in addition to the above described embodiments, the first active mode comprises a normal power mode and the second active mode comprises a non-zero low power mode.

In an embodiment, alternatively or in addition to the above described embodiments, the image update request requests updating information content of at least one pixel of the display panel.

In an embodiment, alternatively or in addition to the above described embodiments, the image update request comprises an image transition request.

In an embodiment, alternatively or in addition to the above described embodiments, the first refresh rate is 60 hertz, and the second refresh rate is in a range of 1-30 hertz.

In an embodiment, alternatively or in addition to the above described embodiments, the intermediate refresh rate is one of 45 hertz and 60 hertz.

The embodiments illustrated and described herein as well as embodiments not specifically described herein but within the scope of aspects of the disclosure constitute exemplary means for temporarily increasing refresh rate for a display panel that is in a low power mode. For example, the elements illustrated in FIG. 1 to FIG. 2 constitute exemplary means for receiving an image update request while the display panel is in a second active mode, exemplary means for keeping the display panel otherwise in the second active mode but switching the display panel to an intermediate refresh rate higher than the second refresh rate until completion of the image update request, and exemplary means for switching the display panel to the second refresh rate after the completion of the image update request.

The term 'computer' or 'computing-based device' is used herein to refer to any device with processing capability such that it can execute instructions. Those skilled in the art will realize that such processing capabilities are incorporated into many different devices and therefore the terms 'computer' and 'computing-based device' each include mobile telephones (including smart phones), tablet computers and many other devices.

The processes described herein may be performed by software in machine readable form on a tangible storage medium e.g. in the form of a computer program comprising computer program code means adapted to perform all the steps of any of the processes described herein when the program is run on a computer and where the computer program may be embodied on a computer readable medium. Examples of tangible storage media include computer storage devices comprising computer-readable media such as disks, thumb drives, memory etc. and do not include propagated signals. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a digital signal processor (DSP), programmable logic array, or the like.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), and the like.

Any range or device value given herein may be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims, and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

Aspects of any of the examples described above may be combined with aspects of any of the other examples described to form further examples without losing the effect sought.

The term 'comprising' is used herein to mean including the blocks or elements identified, but that such blocks or elements do not comprise an exclusive list, and a system, a device or an apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification. In particular, the individual features, elements, or parts described in the context of one example, may be connected in any combination to any other example also.

The invention claimed is:

1. An apparatus, comprising:

a display panel having a first active mode with a first refresh rate and a first bit depth, and further having a second active mode with a second refresh rate and a second bit depth, the second refresh rate being lower than the first refresh rate, and the second bit depth being lower than the first bit depth, wherein the display panel is capable of displaying images at the first bit depth and the second bit depth; and a processor configured to act as a controller, wherein, in response to receiving an image update request while the display panel is in the second active mode, the controller is configured to maintain the second bit depth but switch the display panel to an intermediate refresh rate higher than the second refresh rate and lower than the first refresh rate until completion of the image update request, and, in response to completion of the image update request, switch the display panel from the intermediate refresh rate to the second refresh rate while maintaining the second bit depth.

2. The apparatus as claimed in claim 1, wherein the first active mode comprises a normal power mode.

3. The apparatus as claimed in claim 1, wherein the second active mode comprises a non-zero low power mode.

4. The apparatus as claimed in claim 1, wherein the first refresh rate is 60 hertz, and the second refresh rate is in a range of 1-30 hertz.

5. The apparatus as claimed in claim 4, wherein the second refresh rate is 15 hertz.

6. The apparatus as claimed in claim 1, wherein the first bit depth is 24 bits per pixel, and the second bit depth is 3 bits per pixel.

7. The apparatus as claimed in claim 1, wherein the intermediate refresh rate is one of 45 hertz and 60 hertz.

8. The apparatus as claimed in claim 1, wherein the controller comprises a driver associated with the display panel.

9. The apparatus as claimed in claim 1, wherein the processor is further configured to act as a frame buffer to store image data to be displayed on the display panel.

10. The apparatus as claimed in claim 1, wherein the image update request requests updating information content of at least one pixel of the display panel.

11. The apparatus as claimed in claim 1, wherein the image update request comprises an image transition request.

12. A display unit, comprising:

a display panel having a first active mode with a first refresh rate and at least a first bit depth, and further having a second active mode with a second refresh rate and at least a second bit depth, the second refresh rate being lower than the first refresh rate, and the second bit depth being lower than the first bit depth, wherein the display panel is capable of displaying images at the first bit depth and the second bit depth;

a processor configured to act as:

a controller, and a frame buffer to store image data to be displayed on the display panel, wherein, in response to receiving an image update request while the display panel is in the second active mode, the controller is configured to maintain the second bit depth but switch the display panel to an intermediate refresh rate higher than the second refresh rate and lower than the first refresh rate until completion of the image update request, and, in response to completion of the image update request, switch the display panel from the intermediate refresh rate to the second refresh rate while maintaining the second bit depth.

13. A method, comprising:

receiving, in a controller associated with a display panel, an image update request while the display panel is in a second active mode, the display panel having a first active mode with a first refresh rate and a first bit depth, and further having the second active mode with a second refresh rate and a second bit depth, the second refresh rate being lower than the first refresh rate, and the second bit depth being lower than the first bit depth, wherein the display panel is capable of displaying images at the first bit depth and the second bit depth; and in response to receiving the image update request while the display panel is in the second active mode, keeping the second bit depth of the display panel but switching, by the controller, the display panel to an intermediate refresh rate higher than the second refresh rate and lower than the first refresh rate until completion of the image update request, and, in response to completion of the image update request, switch the display panel from the intermediate refresh rate to the second refresh rate while maintaining the second bit depth.

14. The method as claimed in claim 13, wherein the first active mode comprises a normal power mode and the second active mode comprises a non-zero low power mode.

15. The method as claimed in claim 13, wherein the image update request requests updating information content of at least one pixel of the display panel.

16. The method as claimed in claim 13, wherein the image update request comprises an image transition request.

17. The method as claimed in claim 13, wherein the first refresh rate is 60 hertz, and the second refresh rate is in a range of 1-30 hertz.

18. The method as claimed in claim 13, wherein the intermediate refresh rate is one of 45 hertz and 60 hertz.

19. The apparatus as claimed in claim 1, wherein the second active mode comprises a reduced active area compared to the first active mode.

20. The method of claim 13, wherein the second active mode comprises a reduced active area compared to the first active mode.

* * * * *